US010850307B2

(12) United States Patent
Ashikaga

(10) Patent No.: US 10,850,307 B2
(45) Date of Patent: Dec. 1, 2020

(54) ULTRASONIC DEVICE

(71) Applicant: ROHM CO., LTD., Kyoto (JP)

(72) Inventor: Kinya Ashikaga, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 470 days.

(21) Appl. No.: 15/854,621

(22) Filed: Dec. 26, 2017

(65) Prior Publication Data

US 2018/0281021 A1 Oct. 4, 2018

(30) Foreign Application Priority Data

Mar. 31, 2017 (JP) ..... 2017-070626

(51) Int. Cl.
*B06B 1/06* (2006.01)

(52) U.S. Cl.
CPC ..... *B06B 1/0666* (2013.01)

(58) Field of Classification Search
CPC ..... H01L 41/187; B06B 1/0666
See application file for complete search history.

(56) References Cited

U.S. PATENT DOCUMENTS 6,049,158 A * 4/2000 Takeuchi ..... B41J 2/161 310/324
2010/0020135 A1* 1/2010 Morozumi ..... B41J 2/14233 347/71
2013/0032906 A1* 2/2013 Ogawa ..... H01L 37/02 257/420
2014/0187956 A1* 7/2014 Rice ..... A61B 8/12 600/459
2015/0270472 A1* 9/2015 Nagahata ..... B41J 2/1646 310/365
2016/0043299 A1* 2/2016 Fujimori ..... H01L 41/29 310/330
2016/0351788 A1* 12/2016 Mizukami ..... B41J 2/14233

FOREIGN PATENT DOCUMENTS

JP 2016-225420 A 12/2016

* cited by examiner

*Primary Examiner* — Bryan P Gordon
(74) *Attorney, Agent, or Firm* — Rabin & Berdo, P.C.

(57) ABSTRACT

An ultrasonic device includes a substrate having an opening portion penetrating through the substrate in a thickness direction; a membrane formed on the substrate and having a movable film defining a top surface portion of the opening portion; a lower electrode formed on a front surface of the membrane at a side opposite the opening portion; a piezoelectric film formed on a front surface of the lower electrode at a side opposite the membrane; and an upper electrode formed on a front surface of the piezoelectric film at a side opposite the lower electrode, wherein the movable film of the membrane has a shape that is deflected so as to be convex toward the lower electrode, and wherein the lower electrode is an IrOx/Ir/Ti/Pt laminated film with which an IrOx film, an Ir film, a Ti film, and a Pt film are laminated in that order from the membrane.

10 Claims, 10 Drawing Sheets

ULTRASONIC DEVICE

BACKGROUND OF THE INVENTION

1. Field of the Invention

The present invention relates to an ultrasonic device, such as an ultrasonic receiver, an ultrasonic transceiver, etc.

2. Description of the Related Art

There is known an ultrasonic device that includes a substrate, having an opening portion penetrating through in a thickness direction, a membrane, formed on the substrate so as to cover the opening portion, a lower electrode, formed on a front surface of the membrane at the opposite side of the opening portion side, a piezoelectric film, formed on a front surface of the lower electrode at the opposite side of the membrane side, and an upper electrode, formed on a front surface of the piezoelectric film at the opposite side of the lower electrode side (see Japanese Patent Application Publication No. 2016-225420).

SUMMARY OF THE INVENTION

The inventor of preferred embodiments of the present invention described and claimed in the present application conducted an extensive study and research regarding an ultrasonic device, such as the one described above, and in doing so, discovered and first recognized new unique challenges and previously unrecognized possibilities for improvements as described in greater detail below.

With the ultrasonic device described in Japanese Patent Application Publication No. 2016-225420, when warping occurs in the substrate due to a temperature change, etc., the membrane becomes tensioned and the membrane may break.

An object of the present invention is to provide an ultrasonic device, with which a membrane is unlikely to break even when warping occurs in the substrate.

In order to overcome the previously unrecognized and unsolved challenges described above, a preferred embodiment of the present invention provides a device using a piezoelectric element. A preferred embodiment of the present invention provides an ultrasonic device. The ultrasonic device includes a substrate, having an opening portion penetrating through in a thickness direction, a membrane, formed on the substrate and having a movable film defining a top surface portion of the opening portion, a lower electrode, formed on a front surface of the membrane at the opposite side of the opening portion side, a piezoelectric film, formed on a front surface of the lower electrode at the opposite side of the membrane side, and an upper electrode, formed on a front surface of the piezoelectric film at the opposite side of the lower electrode side, and the movable film of the membrane has a shape that is deflected so as to be convex in a direction toward the lower electrode from the opening portion.

When warping occurs in the substrate due to a temperature change, etc., a tension acts on the movable film of the membrane. With the present arrangement, the movable film of the membrane has the shape that is deflected so as to be convex in the direction toward the lower electrode from the opening portion and therefore in comparison to a case where the movable film does not have a deflection, the movable film can stretch with allowance in response to the tension. The movable film is thereby made unlikely to break or become damaged.

In the present preferred embodiment, if σ1 and t1 are respectively an internal stress per unit thickness and a thickness of the membrane, σ2 and t2 are respectively an internal stress per unit thickness and a thickness of the lower electrode, σ3 and t3 are respectively an internal stress per unit thickness and a thickness of the piezoelectric film, σ4 and t4 are respectively an internal stress per unit thickness and a thickness of the upper electrode, and each internal stress is expressed with the sign of tensile stress being positive and the sign of compressive stress being negative, σ1 to σ4 and t1 to t4 satisfy the following formula (a):

$$t1\cdot\sigma1+t2\cdot\sigma2+t3\cdot\sigma3+t4\cdot\sigma4<0 \quad \text{(a)}$$

In the preferred embodiment of the present invention, the membrane and the upper electrode have compressive stresses and the lower electrode and the piezoelectric film have tensile stresses.

In the preferred embodiment of the present invention, the lower electrode is a Ti/Pt laminated film having a Ti film, formed on the front surface of the membrane, and a Pt film, formed on the Ti film.

In the preferred embodiment of the present invention, the lower electrode is an IrOx/Ir/Ti/Pt laminated film with which an IrOx film, an Ir film, a Ti film, and a Pt film are laminated in that order from the membrane side.

In the preferred embodiment of the present invention, the piezoelectric film is constituted of a ferroelectric oxide containing Pb, Ti, and Zr.

In the preferred embodiment of the present invention, the upper electrode is an IrOx/Ir laminated film with which an IrOx film and an Ir film are laminated in that order from the piezoelectric film side.

In the preferred embodiment of the present invention, the membrane is $SiO_2$.

In the preferred embodiment of the present invention, the membrane is constituted of an SiN film or an $Al_2O_3$ film.

In the preferred embodiment of the present invention, the membrane is constituted of an AlN film.

In the preferred embodiment of the present invention, the upper electrode has a peripheral edge spreading further outward than the opening portion in a plan view of viewing from a thickness direction of the membrane.

In the preferred embodiment of the present invention, in the plan view, the opening portion is rectangular and the upper electrode has a rectangular main electrode portion, having the peripheral edge spreading further outward than the opening portion, and an extension portion, extending outward from a central portion of one side of the main electrode portion.

In the preferred embodiment of the present invention, a contact hole, arranged to expose a portion of the lower electrode, is formed in the piezoelectric film.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

A preferred embodiment of the present invention shall now be described in detail with reference to the attached drawings.

Figure 1:
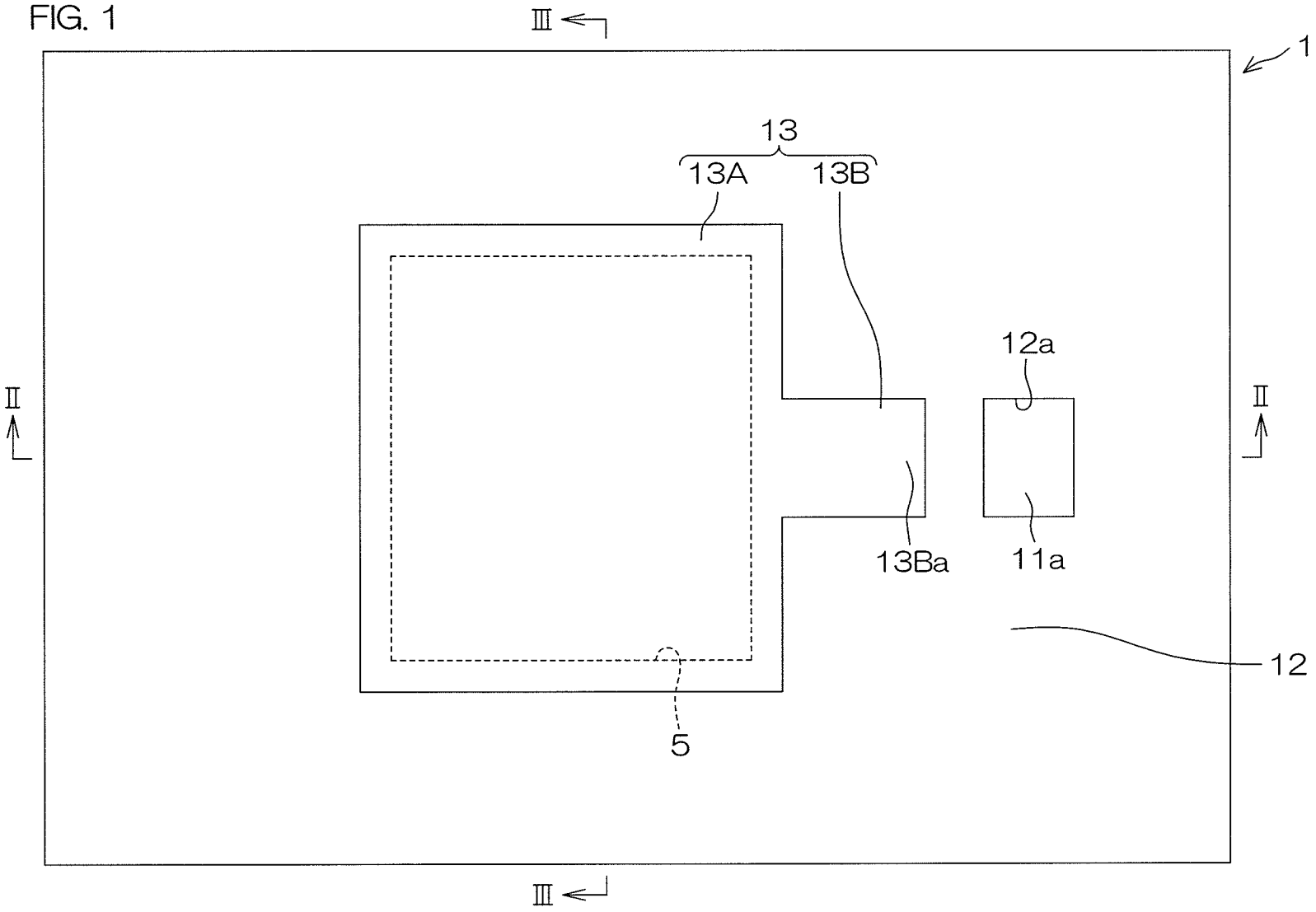
FIG. 1 is an illustrative plan view of an ultrasonic device according to a preferred embodiment of the present invention.
Figure 2:
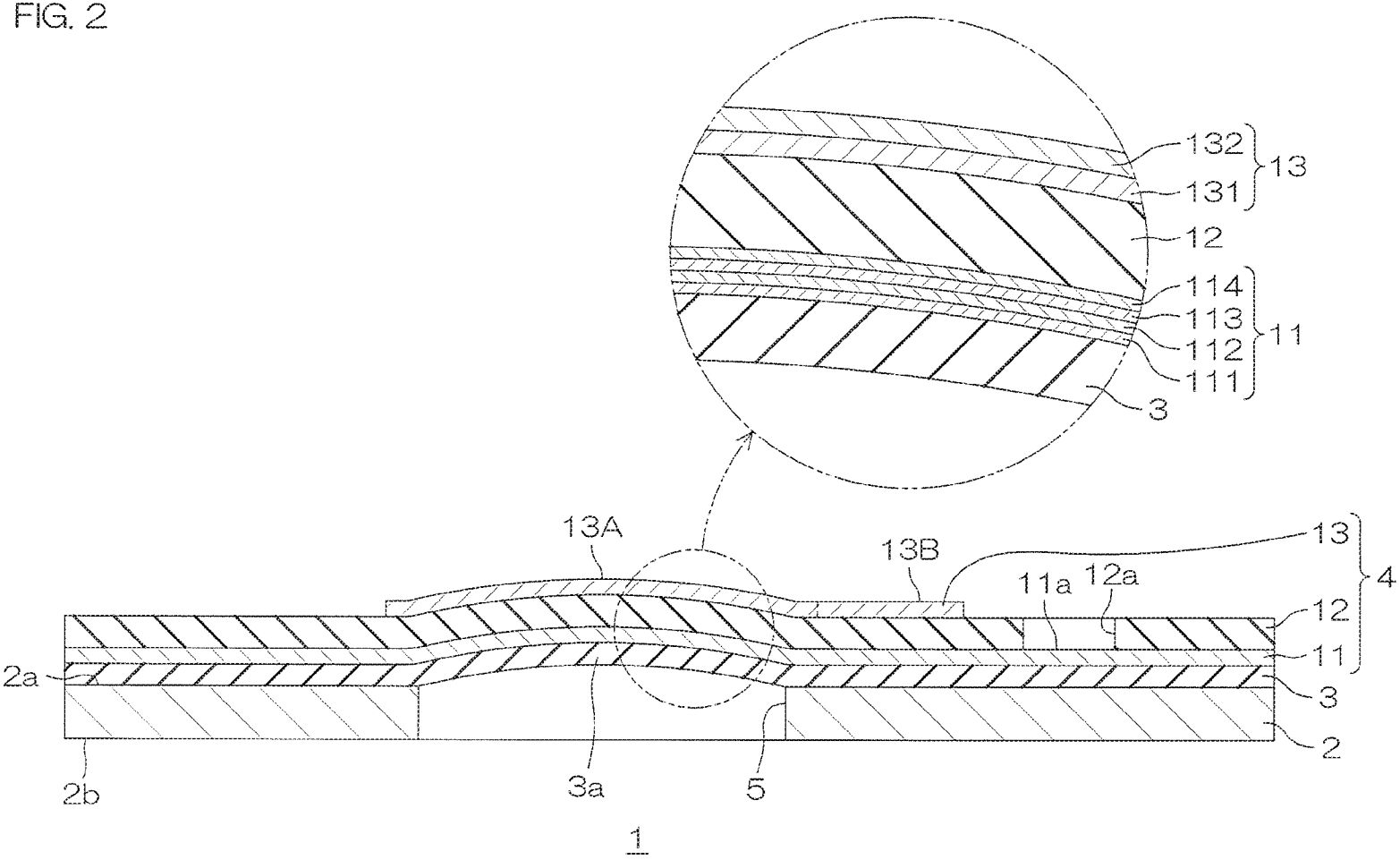
FIG. 2 is an illustrative sectional view taken along line II-II of FIG. 1.
Figure 3:
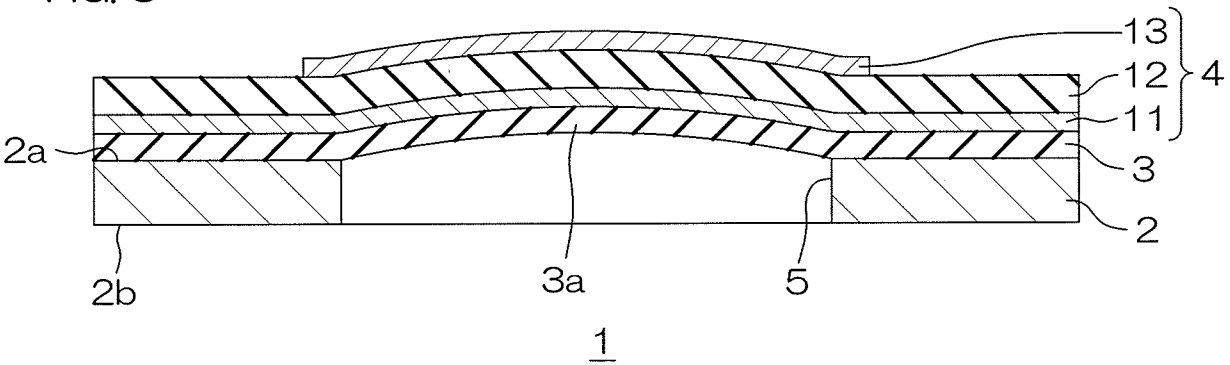
FIG. 3 is an illustrative sectional view taken along line III-III of FIG. 1.

FIG. 1 is an illustrative plan view of an ultrasonic device according to a preferred embodiment of the present invention. FIG. 2 is an illustrative sectional view taken along line II-II of FIG. 1. FIG. 3 is an illustrative sectional view taken along line III-III of FIG. 1.

The ultrasonic device 1 includes a substrate 2, having a front surface 2*a* and a rear surface 2*b*, a membrane (vibrating plate) 3, formed on the front surface 2*a* of the substrate 2, and a piezoelectric element 4, formed on a front surface of the membrane 3 at the opposite side of the substrate 2 side.

The substrate 2 is a flat rectangular parallelepiped. In the present preferred embodiment, the substrate 2 is constituted of a silicon (Si) substrate. An opening portion 5, penetrating through the substrate 2 in a thickness direction, is formed in a central portion of the substrate 2. The opening portion 5 is formed so that a piezoelectric film 12, to be described below, can vibrate readily. The opening portion 5 has an oblong shape in a plan view of viewing from a thickness direction of the membrane 3. The four sides of the opening portion 5 are respectively parallel to the four sides of the substrate 2.

The membrane 3 is formed on the substrate 2 so as to cover the opening portion 5. A portion of the membrane 3 that is a top wall portion of the opening portion 5 constitutes a movable film 3*a*. In the present preferred embodiment, the membrane 3 is constituted of a silicon oxide film ($SiO_2$ film). The membrane 3 may instead be constituted of an SiN film, an $Al_2O_3$ film, or an AlN (aluminum nitride) film, etc. The membrane 3 has a thickness, for example, of approximately 1.4 μm in the case of the silicon oxide film. In the present specification, the movable film 3*a* refers to the top wall portion of the membrane 3 that defines a top surface portion of the opening portion 5.

The piezoelectric element 4 includes a lower electrode 11, formed on the front surface of the membrane 3 at the opposite side of the opening portion 5 side, the piezoelectric film 12, formed on a front surface of the lower electrode 11 at the opposite side of the membrane 3 side, and an upper electrode 13, formed on a front surface of the piezoelectric film 12 at the opposite side of the lower electrode 11 side.

The lower electrode 11 is formed across an entirety of the front surface of the membrane 3. The lower electrode 11 may be constituted of a Ti/Pt laminated film, constituted of a Ti (titanium) film (for example of 20 nm thickness), formed on the membrane 3, and a Pt (platinum) film (for example of 200 nm thickness), formed on the Ti film. The lower electrode 11 has a thickness, for example, of approximately 220 nm. As shown in FIG. 2, the lower electrode 11 may instead be constituted, for example, of an IrOx/Ir/Ti/Pt laminated film, in which an IrOx (iridium oxide) film 111, an Ir (iridium) film 112, a Ti film 113, and a Pt film 114 are formed successively from the membrane 3 side.

The piezoelectric film 12 is formed across substantially an entirety of the front surface of the lower electrode 11. In the piezoelectric film 12, an opening portion 12*a* of oblong shape is formed at a position between an intermediate portion of one side of the opening portion 5 and an intermediate portion of the corresponding side of the substrate 2 in plan view. The opening portion 12*a* penetrates through the piezoelectric film 12 in the thickness direction and a portion of the front surface of the lower electrode 11 is exposed via the opening portion 12*a*. The exposed portion constitutes a pad portion 11*a* arranged to connect the lower electrode 11 to an exterior. That is, the opening portion 12*a* is a contact hole for making contact with the lower electrode 11. In the present preferred embodiment, the piezoelectric film 12 is constituted, for example, of a PZT ($PbZr_xTi_{1-x}O_3$: lead zirconium titanate) film formed by a sol-gel method or a sputtering method. Such a piezoelectric film 12 is constituted of a sintered body of a metal oxide crystal. The piezoelectric film 12 has a thickness, for example, of approximately 1 μm.

The upper electrode 13 is formed on the piezoelectric film 12. In plan view, the upper electrode 13 is formed in a region corresponding to a central portion of the substrate 2. In plan view, the upper electrode 13 has a peripheral edge spreading further outward than the opening portion 5. Specifically, in plan view, the upper electrode 13 has a main electrode portion 13A, formed in an oblong-shaped region including the opening portion 5 and its peripheral portion, and an extension portion 13B, extending from the main electrode portion 13A toward the opening portion 12*a* side of the piezoelectric film 12.

In plan view, the main electrode portion 13A is of an oblong shape substantially similar to the top surface portion of the opening portion 5 of the substrate 2 and larger than the top surface portion of the opening portion 5. A length in a long direction of the main electrode portion 13A is formed to be longer than a length in a long direction of the top surface portion of the opening portion 5. Respective side edges along a short direction of the main electrode portion 13A are respectively disposed at outer sides, across predetermined intervals, of respective corresponding side edges of the top surface portion of the opening portion 5. Also, a width in the short direction of the main electrode portion 13A is formed to be longer than a width in a short direction of the top surface portion of the opening portion 5. Respective side edges along the long direction of the main electrode portion 13A are respectively disposed at outer sides, across predetermined intervals, of respective corresponding side edges of the top surface portion of the opening portion 5.

In plan view, the extension portion 13B extends from a central portion of a side edge, among both side edges of the main electrode portion 13A, at the opening portion 12*a* side of the piezoelectric film 12, to a vicinity of the opening portion 12*a*. A front surface of a tip portion of the extension portion 13B constitutes a pad portion 13Ba arranged to connect the upper electrode 13 to the exterior.

In the present preferred embodiment, the upper electrode 13 is constituted of a laminated film (IrOx/Ir laminated film) of an IrOx (iridium oxide) film 131, formed on the piezoelectric film 12, and an Ir (iridium) film 132, formed on the IrOx film 131. The IrOx film 131 has a thickness of approximately 50 nm and the Ir film 132 has a thickness of approximately 50 nm. That is, the upper electrode 13 has a thickness of approximately 100 nm.

As shown in FIG. 2 and FIG. 3, the movable film 3*a* of the membrane 3 has a shape that is deflected so as to be convex in a direction toward the lower electrode 11 side from the opening portion 5 side (direction in which the front surface at the lower electrode 11 side of the membrane 3 faces (upward direction)). That is, the movable film 3*a* has a shape that is deflected so that a height position of its central portion is higher than a height position of its peripheral edge portion.

Such a shape of the movable film 3*a* is obtained by adjusting internal stresses and the thicknesses of the membrane 3, the lower electrode 11, the piezoelectric film 12, and the upper electrode 13. This point shall now be described specifically. Let the internal stresses per 1 μm of the membrane 3, the lower electrode 11, the piezoelectric film 12, and the upper electrode 13 be σ1, σ2, σ3, and σ4 (MPa), respectively. Here, each internal stress is expressed with the sign of tensile stress being positive and the sign of compressive stress being negative. Also, let the film thicknesses of the membrane 3, the lower electrode 11, the piezoelectric film 12, and the upper electrode 13 be t1, t2, t3, and t4 (μm), respectively. An ultrasonic device, with which the movable film 3*a* has a shape that is deflected so as to be convex in the upward direction is obtained by adjusting the materials and film thicknesses of the membrane 3, the lower electrode 11, the piezoelectric film 12, and the upper electrode 13 so that σ1 to σ4 and t1 to t4 satisfy the following formula (1):

$$t1\cdot\sigma1+t2\cdot\sigma2+t3\cdot\sigma3+t4\cdot\sigma4<0 \quad (1)$$

In the present preferred embodiment, the membrane 3 and the upper electrode 13 have compressive stresses and the lower electrode 11 and the piezoelectric film 12 have tensile stresses so that σ1<0, σ2>0, σ3>0, and σ4<0.

Table 1 shows an example of the materials, the internal stresses (MPa), and the film thicknesses (μm) of the membrane 3, the lower electrode 11, the piezoelectric film 12, and the upper electrode 13 that constitute the ultrasonic device 1.

TABLE 1

| | Material | Internal stress (MPa) | Film thicknesses (μm) |
|---|---|---|---|
| Membrane | $SiO_2$ | −350 | 1.4 |
| Lower electrode | Ti/Pt | 1000 | 0.22 |
| Piezoelectric film | PZT | 200 | 1.0 |
| Upper electrode | $IrO_2$/Ir | −1800 | 0.1 |

The ultrasonic device 1 described above may be used as an ultrasonic transceiver that transmits an ultrasonic wave and receives the reflection thereof or as an ultrasonic receiver that receives an ultrasonic wave.

Transmission by the ultrasonic device 1 is performed by applying an AC voltage across the lower electrode 11 and the upper electrode 13. That is, when an AC voltage is applied across both electrodes 11 and 13, the piezoelectric film 12 vibrates due to an inverse piezoelectric effect. The movable film 3*a* of the membrane 3 thereby vibrates and an ultrasonic wave is generated by air in the vicinity being pushed outward.

Reception of an ultrasonic wave is performed by detection of a voltage generated across the lower electrode 11 and the upper electrode 13 by the ultrasonic wave. That is, when an ultrasonic wave is received, the movable film 3*a* of the membrane 3 vibrates so that the piezoelectric film 12 deflects and a voltage is generated across the two surfaces of the piezoelectric film 12 due to a piezoelectric effect. By the voltage being taken out via the lower electrode 11 and the upper electrode 13, an intensity of the ultrasonic wave is detected. With an ultrasonic transceiver, the transmission and reception of an ultrasonic wave are performed by time division.

The preferred embodiment described above has the following merits because the movable film 3*a* of the membrane 3 has the shape that is deflected so as to be convex in the direction (upward direction) toward the lower electrode 11 from the opening portion 5. When warping occurs in the substrate 2 due to a temperature change, etc., a tension acts on the movable film 3*a* of the membrane 3. With the preferred embodiment described above, the movable film 3*a* of the membrane 3 has the shape that is deflected so as to be convex in the upward direction and therefore in comparison to a case where the movable film 3*a* does not have a deflection, the movable film 3*a* can stretch with allowance in response to the tension. The movable film 3*a* is thereby made unlikely to break or become damaged.

FIG. 4 to FIG. 10 are sectional views of an example of a manufacturing process of the ultrasonic device 1 and show a section plane corresponding to FIG. 2. In FIG. 4 to FIG. 10, the deflection of the membrane 3, etc., is not shown for convenience of description.

Figure 4:
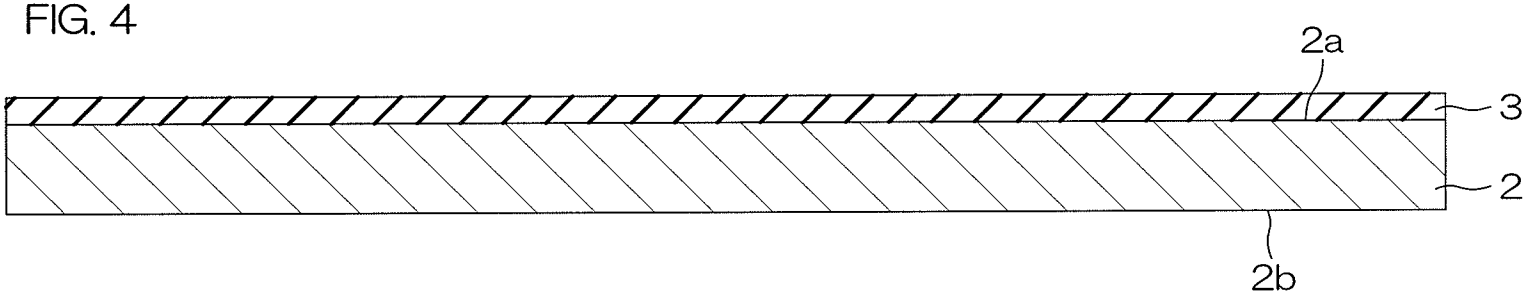
FIG. 4 is a sectional view of an example of a manufacturing process of the ultrasonic device.

First, as shown in FIG. 4, the membrane 3 is formed across an entire surface of the front surface 2*a* of the substrate 2. Specifically, an $SiO_2$ film (for example of 1.4 μm thickness) is formed on the front surface of the silicon substrate 2 by a sputtering method. However, as the substrate 2, that which is thicker than the thickness of the substrate 2 in the final stage is used.

Figure 5:
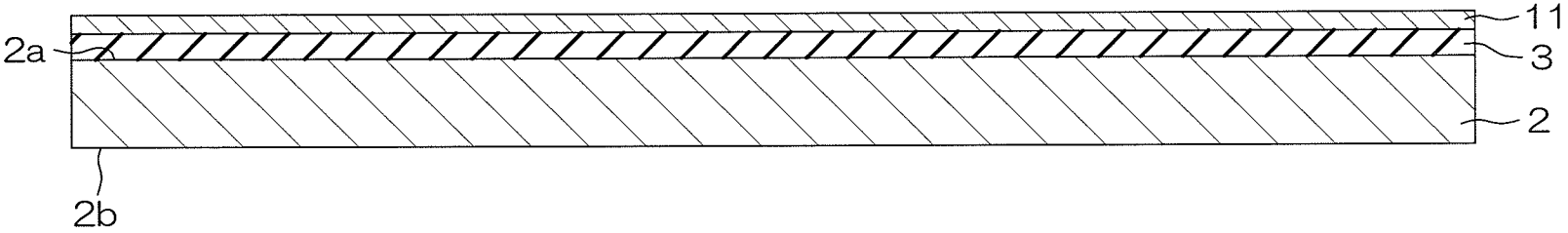
FIG. 5 is a sectional view of a step subsequent to that of FIG. 4.

Next, as shown in FIG. 5, the lower electrode 11 is formed across an entire surface of the front surface of the membrane 3 by the sputtering method. The lower electrode 11 is constituted of the Ti/Pt laminated film, constituted of the Ti film (for example of 20 nm thickness), formed on the membrane 3, and the Pt film (for example of 200 nm thickness), formed on the Ti film.

Figure 6:
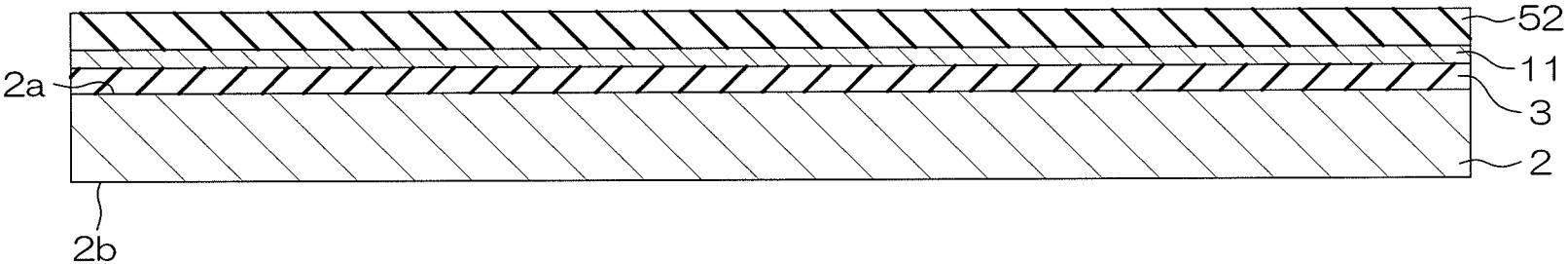
FIG. 6 is a sectional view of a step subsequent to that of FIG. 5.

Next, as shown in FIG. 6, a piezoelectric material film 52, which is a material film of the piezoelectric film 12, is formed across an entire surface of the front surface of the lower electrode 11. Specifically, the piezoelectric material film 52, for example of 1 μm thickness, is formed, for example, by a sol-gel method. Such a piezoelectric material film 52 is constituted of a sintered body of a metal oxide crystal grains.

Figure 7:
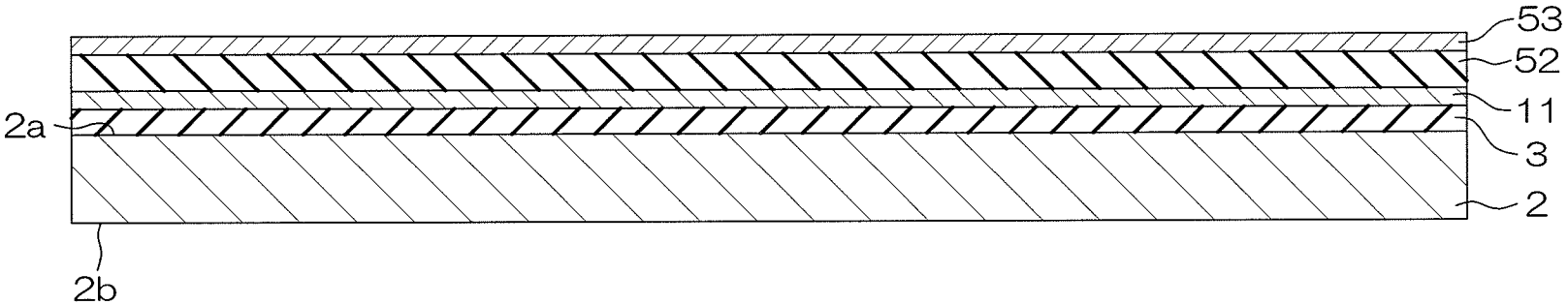
FIG. 7 is a sectional view of a step subsequent to that of FIG. 6.

Next, as shown in FIG. 7, an upper electrode film 53, which is a material film of the upper electrode 13, is formed across an entire surface of a front surface of the piezoelectric material film 52 by the sputtering method. The upper electrode film 53 is constituted, for example, of a laminated film of $IrO_2$/Ir, constituted of an $IrO_2$ film (for example of 50 nm thickness), formed on the piezoelectric material film 52, and an Ir film (for example of 50 nm thickness), formed on the $IrO_2$ film.

Next, patterning of the upper electrode film 53 and the piezoelectric material film 52 is performed as shown in FIG.

Figure 8:
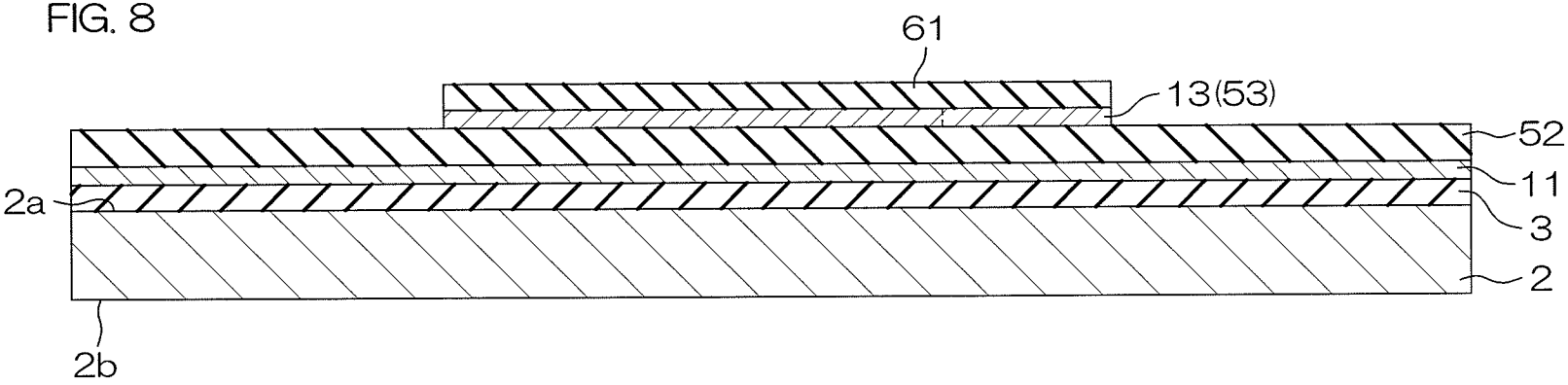
FIG. 8 is a sectional view of a step subsequent to that of FIG. 7.
Figure 9:
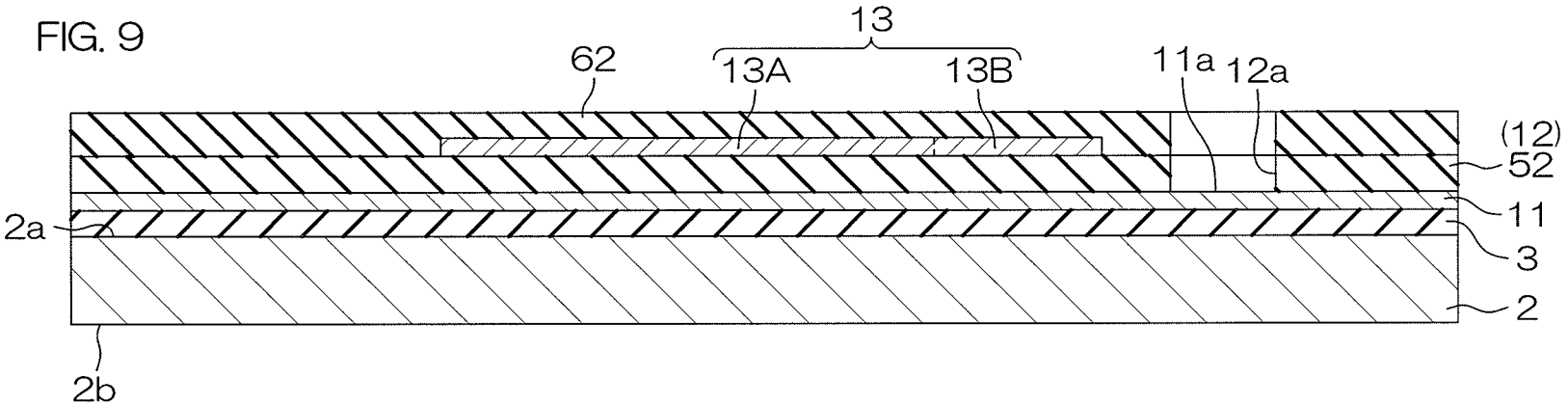
FIG. 9 is a sectional view of a step subsequent to that of FIG. 8.

8 and FIG. 9. First, as shown in FIG. 8, a resist mask 61, with a pattern of the upper electrode 13, is formed by photolithography. By the upper electrode film 53 then being dry-etched using the resist mask 61 as a mask, the upper electrode 13 of a predetermined pattern is formed. The upper electrode 13, constituted of the main electrode portion 13A and the extension portion 13B, is thereby obtained.

Next, as shown in FIG. 9, after peeling off the resist mask 61, a resist mask 62, with a pattern of the piezoelectric film 12, is formed by photolithography. By the piezoelectric material film 52 then being dry-etched using the resist mask 62 as a mask, the piezoelectric film 12 of a predetermined pattern is formed. The piezoelectric film 12, having the opening portion 12*a*, is thereby obtained.

Figure 10:
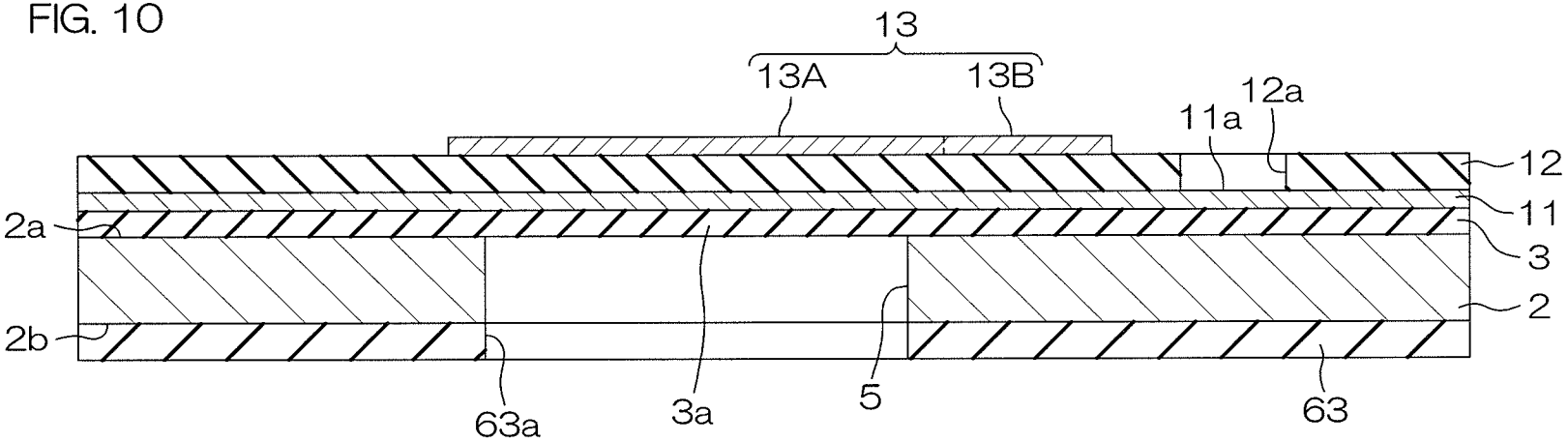
FIG. 10 is a sectional view of a step subsequent to that of FIG. 9.

Next, as shown in FIG. 10, after peeling off the resist mask 62, a resist mask 63, having an opening 63*a* corresponding to the opening portion 5, is formed on the rear surface 2*b* of the substrate 2 by photolithography. By the substrate 2 then being dry-etched from the rear surface using the resist mask 63 as a mask, the opening portion 5 is formed in the substrate 2. Next, after peeling off the resist mask 63, the substrate 2 is polished from the rear surface 2*b* to thin the substrate 2. For example, the substrate 2 with a thickness of approximately 625 μm in the initial state may be thinned to a thickness of approximately 300 μm. The ultrasonic device 1 shown in FIG. 1 to FIG. 3 is thereby obtained.

The present application corresponds to Japanese Patent Application No. 2017-70626 filed on Mar. 31, 2017 in the Japan Patent Office, and the entire disclosure of this application is incorporated herein by reference.

While preferred embodiments of the present invention have been described above, it is to be understood that variations and modifications will be apparent to those skilled in the art without departing the scope and sprit of the present invention. The scope of the present invention, therefore, is to be determined solely by the following claims.

What is claimed is:

1. An ultrasonic device, comprising:

a substrate having an opening portion penetrating through the substrate in a thickness direction;

a membrane formed on the substrate and having a movable film defining a top surface portion of the opening portion;

a lower electrode formed on a front surface of the membrane at a side opposite the opening portion;

a piezoelectric film formed on a front surface of the lower electrode at a side opposite the membrane; and an upper electrode formed on a front surface of the piezoelectric film at a side opposite the lower electrode, wherein the movable film of the membrane has a shape that is deflected so as to be convex in a direction toward the lower electrode from the opening portion, and wherein the lower electrode is an IrOx/Ir/Ti/Pt laminated film with which an IrOx film, an Ir film, a Ti film, and a Pt film are laminated in that order from the membrane.

2. The ultrasonic device according to claim 1, wherein the membrane and the upper electrode have compressive stresses and the lower electrode and the piezoelectric film have tensile stresses.

3. The ultrasonic device according to claim 1, wherein the piezoelectric film is constituted of a ferroelectric oxide containing Pb, Ti, and Zr.

4. The ultrasonic device according to claim 3, wherein the upper electrode is an IrOx/Ir laminated film with which an IrOx film and an Ir film are laminated in that order from the piezoelectric film side.

5. The ultrasonic device according to claim 4, wherein the membrane is constituted of a $SiO_2$ film.

6. The ultrasonic device according to claim 4, wherein the membrane is constituted of an SiN film or an $Al_2O_3$ film.

7. The ultrasonic device according to claim 4, wherein the membrane is constituted of an AlN film.

8. The ultrasonic device according to claim 1, wherein the upper electrode has a peripheral edge spreading further outward than the opening portion in a plan view of viewing from a thickness direction of the membrane.

9. The ultrasonic device according to claim 8, wherein, in the plan view, the opening portion is rectangular and the upper electrode has a main electrode portion, being of a rectangular shape substantially similar to the opening and having the peripheral edge spreading further outward than the opening portion, and an extension portion, extending outward from a central portion of one side of the main electrode portion.

10. The ultrasonic device according to claim 9, wherein a contact hole, arranged to expose a portion of the lower electrode, is formed in the piezoelectric film.

* * * * *